US005693141A

United States Patent [19]

Tramont

[11] Patent Number: 5,693,141

[45] Date of Patent: Dec. 2, 1997

[54] SPECIAL EFFECT PAINT ROLLER

[76] Inventor: Thomas J. Tramont, 46 Ridgewood Rd., West Hartford, Conn. 06107

[21] Appl. No.: 505,779

[22] Filed: Jul. 21, 1995

[51] Int. Cl.[6] ..... B05C 1/00

[52] U.S. Cl. ..... 118/211; 118/244; 118/256; 118/258; 118/264; 118/DIG. 14; 118/DIG. 15; 15/210.5; 15/230.11

[58] Field of Search ..... 118/211, 244, 118/256, 258, 264, DIG. 14, DIG. 15; 492/19, 20, 30, 55, 56; 29/895.3; 15/210.5, 230.11

[56] References Cited

U.S. PATENT DOCUMENTS

| | | | |
|---|---|---|---|
| 1,903,152 | 3/1933 | Watson et al. | 15/248.2 |
| 3,955,260 | 5/1976 | Sherden | 118/DIG. 15 |
| 4,191,792 | 3/1980 | Janssen | 427/260 |
| 4,257,140 | 3/1981 | Downing | 15/230.11 |
| 4,756,065 | 7/1988 | Carlson | 492/56 |
| 4,919,975 | 4/1990 | Jones | 427/260 |
| 4,930,179 | 6/1990 | Wright et al. | 15/230.11 |
| 5,117,529 | 6/1992 | Ohta | 15/230.11 |
| 5,206,979 | 5/1993 | Campbell | 15/230.11 |
| 5,471,703 | 12/1995 | Niven | 15/210.5 |

FOREIGN PATENT DOCUMENTS

| | | | |
|---|---|---|---|
| 89031 | 10/1931 | Australia | 15/210.5 |
| 604630 | 7/1948 | United Kingdom . | |

OTHER PUBLICATIONS

"A Guide to Decorative Paint Techniques", brochure, McCloskey, JT #427/94, undated.

"The Personality of Color", brochure, Pratt & Lambert Paints No. 010–6200–047, undated.

"How to Create Fantasy Finishes With Flair & Imagination", brochure—Benjamin Moore Paints, No. 070–116, Printed in Canada Jan. 1991.

"Decorative Painting Brushes & Tools For the Specialist Painter", brochure—Old World Brush & Tool Co., St. Charles, MO, undated.

"Graham Designer Series"—Waterborne Faux Finish System, one sheet advertising, undated.

"The Future is Multicolored"—Spectura—Surface Protection Industries International, North Billerica, MA—one sheet advertising, undated.

"Decorators' Partnership Appeals to Wider Range of Tastes" newspaper article, The Harford Courant, Jun. 21, 1995, p. B–1.

*Primary Examiner*—Laura Edwards
*Attorney, Agent, or Firm*—Alix, Yale & Ristas, LLP

[57] ABSTRACT

Paint rollers (11–15) having an outer annular paint roll medium (21–25) configured and constructed to produce special effects when rolled over a work surface in a positive or negative mode of painting or in one case, in both modes simultaneously. In three embodiments, the outer medium (21–25) is constructed from a sheet of flexible material such as a sheet of thin non-porous (e.g., plastic) material or a sheet of thick resilient porous material by loosely compacting a blank of the material into a preformed shape and then wrapping the preformed shape around and affixing it to an inner roller core (16). In another embodiment, a sculptured outer medium (24) is formed by wrapping a preformed shape of sponge or sponge-like material around and affixing it to an inner roller core (16). In a further embodiment, the outer medium (25) is formed by a base layer (80) of resilient porous material and by relatively hard areas of non-porous material (88) at the outer surface of the base layer (80).

14 Claims, 13 Drawing Sheets

SPECIAL EFFECT PAINT ROLLER

BACKGROUND OF THE INVENTION

1. Field of Invention

The present invention relates generally to paint rollers of the type having an inner core and an outer annular paint roll medium extending around the core and affixed to the core for rotation therewith when the paint roller is rolled over a work surface. More particularly, the present invention relates to a new and improved paint roller of the type described having an outer annular paint roll medium configured and constructed to produce a special effect when the paint roller is rolled over a work surface with the outer paint roll medium engaging the work surface with a suitable force.

2. Description of Prior Art

The art of producing "faux" finishes and other special effects is centuries old. It is experiencing a rebirth and is a popular decorating technique today. Although a variety of procedures have been used to produce special effects, paint rollers have not been used or proposed for that purpose except in very limited ways in which the paint rollers have hard ribs or ridges for producing a pattern of specific shapes or a wood grain or other similar finish. For example, rollers have been proposed or used for producing patterns of flowers, stars and hearts. See, for example U.S. Design Pat. No. 287,312, granted Dec. 23, 1986 and entitled "Paint Roller". Such rollers work best by applying a uniform force on the paint roller and rolling the paint roller in one direction across the work surface.

Make-shift, labor intensive procedures have been and are currently being used to produce irregular patterns or finishes. Sponge painting and rag painting are probably the most prevalent. In sponge painting, a sponge is manually dabbed against the work surface to apply or remove paint. In rag painting, a piece of cloth or other similar material is bunched up and then dabbed or rolled over a work surface to apply or remove paint. In a "dragging" procedure, a comb or other article is dragged over a wet paint surface to produce lines in the painted surface. In a "smoozing" procedure, separate spots of wet paint of different colors are brushed together with a dry brush to blend the spots together. Multicolor paints, which are now available, are used with one or more of the foregoing procedures to produce a speckled effect. All of these techniques are difficult, messy and time consuming. They require a high degree of dexterity and artistic skill.

SUMMARY OF INVENTION

Five special effect paint rollers incorporating different embodiments of the present invention are hereafter described in detail. The paint rollers can be selectively used in a positive mode or negative mode of painting, except that in the case of one paint roller, the paint roller is used in both modes simultaneously. In a positive mode of painting, the work surface is dry initially, the outer paint roll medium of the paint roller is maintained relatively wet with paint and the paint roller, when manually rolled over the work surface, marks the work surface with paint where the outer medium contacts the work surface. In the negative mode of painting, a coat of paint is applied to the work surface, the outer medium is maintained relatively dry and the paint roller, when manually rolled over the wet painted surface, marks the surface where the outer medium contacts the work surface, either by removing paint from the surface or by smooshing or pushing the wet paint across the surface. Where both modes are used at the same time, when the paint roller is manually rolled over the work surface, part of the outer medium applies paint to the work surface in the positive mode of painting while another part of the outer medium marks the wet painted surface in the negative mode of painting.

The present invention is relatively easy to use and is particularly suited for the "do-it-yourself" painter having limited experience. The present invention enables a painter to produce a special effect considerably faster than sponge painting or rag painting. Also, the present invention helps overcome the difficulty encountered in sponge painting of achieving uniform effect over the entire work surface due to the application of paint to one small area at a time. With the present invention, an overall uniform effect is easier to achieve. Further, the present invention enables the painter to cover a large area quickly and so that the paint does not dry before the desired effect is achieved on the entire area—thereby overcoming a major problem encountered in sponge or rag painting, particularly in the negative mode of painting.

A paint roller according to the present invention has notable use in painting a "faux" finish or other special effect on a large surface area such as a wall or ceiling, but may also be used to produce a special effect on other surfaces such as the relatively flat surfaces of furniture and picture, window and door frames.

Preferably, the inner core of the paint roller is designed for mounting the paint roller on a paint roller handle so that the paint roller can be manually rolled over a work surface with the handle in a conventional manner.

The present invention is primarily useful in producing an overall effect—not to produce an exact pattern or reproduction of a specific shape or finish. The present invention is useful in producing an effect which can be changed by varying the roller force, by varying the rolling direction, and by rolling the paint roller over the same area two or more times in the same or different directions.

A principal aim of the present invention is to provide a new and improved paint roller which can be manually rolled over a work surface to produce a "faux" finish or other special effect of the type conventionally produced by sponge or rag painting.

Another aim of the present invention is to provide a new and improved paint roller which can be mounted on and manipulated by a paint roller handle to produce a special effect relatively quickly by manually rolling the paint roller over a work surface with the outer medium of the paint roller engaging the work surface with a selected force.

Another aim of the present invention is to provide a new and improved paint roller having an outer annular paint roll medium constructed from a sheet of flexible material. In accordance with the present invention, the sheet of flexible material can be a sheet of non-porous material such as a sheet of thin plastic material or a sheet of resilient porous material such as a sheet of open cell, resilient foam material or chamois-like material. The sheet of flexible material has a surface area significantly greater than the outer annular surface of the roller core and so that the outer paint roll medium is provided by a compacted, three-dimensional shape of the sheet material wrapped around and affixed to the inner core.

Another aim of the present invention is to provide a new and improved paint roller having an outer annular paint roll medium with an irregular outer surface having a plurality of surface voids and raised surface areas extending irregularly in various directions and operable to produce a special effect relatively quickly by manually rolling the paint roller over a work surface with the outer medium engaging the work surface with a suitable force. In accordance with the present invention, the surface voids and raised surface areas may be provided by constructing the outer paint roll medium from (a) a sheet of flexible material having a surface area significantly greater than the outer annular surface of the inner core and so that the outer paint roll medium is provided by a compacted three-dimensional shape of the sheet material wrapped around and affixed to the inner core; or (b) a resilient porous material having an outer surface with voids and raised areas.

It is another aim of the present invention to provide a new and improved paint roller having an outer paint roll medium constructed to apply paint to the work surface in the positive mode of painting and at the same time mark the wet paint surface in the negative mode of painting.

Other objects will be in part obvious and in part pointed out more in detail hereinafter.

A better understanding of the invention will be obtained from the following detailed description and the accompanying drawings of illustrative applications of the invention.

DESCRIPTION OF PREFERRED EMBODIMENTS

Figure 1:
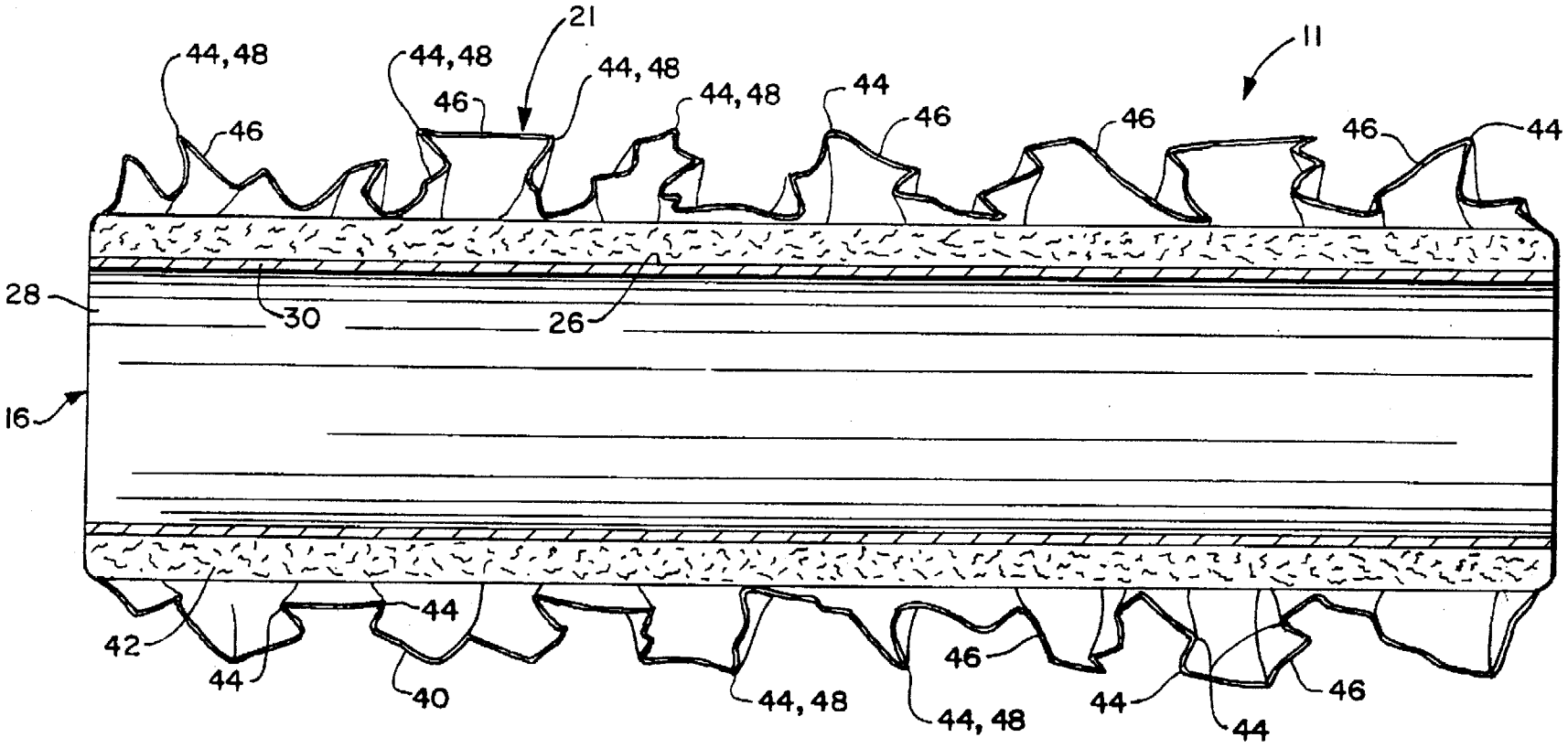
FIGS. 1–5 are axial section views, partly in section, of five different paint rollers incorporating five different embodiments of the present invention.

In the drawings, like numerals are used to designate the same or like parts.

Five paint rollers 11–15 incorporating different embodiments of the present invention are shown in the drawings. The five rollers 11–15 have identical roller cores 16 and different outer, annular, paint roll mediums 21–25 surrounding the roller cores 16. The roller cores 16 have a central axis of rotation and an outer annular surface 26 and are made by cutting off selected lengths of tubular core stock. The roller cores shown in the drawings have a conventional design with a generally cylindrical outer surface 26. For example, the roller cores 16 have a length of 9 inches, a large (e.g., approximately 1½ inch) diameter axial opening 28 and a thin rigid tubular wall 30 (e.g., having a thickness of approximately 1/32 inch).

The axial opening 28 in the roller core is provided for mounting the paint roller on a conventional paint roller handle (not shown). See, for example, U.S. Pat. No. 4,191,792, dated Mar. 4, 1980 and entitled "Paint Roller". Therefore, a paint roller handle can be employed in a generally conventional manner for manually rolling the paint roller over a work surface (e.g., ceiling, wall, flat wood surface, etc.) with the outer paint roll medium engaging the work surface with a selected force.

The outer, annular paint roll medium 21–25 of each paint roller 11–15 is affixed to the roller core 16 in a manner which maintains the shape of the outer medium 21–25 and ensures that the outer medium 21–25 and roller core 16 rotate together as the paint roller is rolled over a work surface (e.g., with a paint roller handle as described or manually without a handle).

Each paint roller 11–15 can be selectively used in a positive mode or negative mode of painting, or, in the case of one paint roller 15, is used in both modes simultaneously. Before using the paint rollers 11–15 in either mode (or both modes simultaneously), the work surface is preferably painted with a desired background color (e.g., with a conventional paint roller, not shown). After the background color dries, one or more of the paint rollers 11–15 are used to paint one or more different patterns on the work surface in one or more separate and distinct painting stages.

When a paint roller 11–15 is used in the positive mode of painting (or in both modes simultaneously), the outer medium 21–25 is maintained relatively wet by periodically loading the outer medium 21–25 with an appropriate amount of paint, preferably in a conventional manner by partly immersing the paint roller in a tray of paint and then rolling the paint roller across a surface of the tray or another suitable surface to remove excess paint from the outer medium 21–25 and to spread the remaining paint generally evenly around the paint roller 11–15. The wet paint roller 11–15 is then manually rolled over a dry work surface with a suitable force to roll paint from the outer medium 21–25 onto the work surface.

In the negative mode of painting, the outer medium 21–25 is maintained relatively dry and the paint roller 11–15 is manually rolled over a work surface to which a suitable base coating of paint has just been applied and is still wet enough for both removing and moving the wet paint with the paint roller 11–15 by rolling the paint roller over the work surface with a suitable force.

In the positive mode of painting, the paint may be a conventional paint or a colored glazing of the type employed in sponge and cloth painting. Where a colored glazing is used, an appropriate pigment is added to uncolored glazing to obtain the desired color. In the negative mode of painting, a colored glazing is preferably used.

Each paint roller 11–15 can be employed to paint an irregular pattern of markings spaced relatively far apart or relatively close together, depending on the applied roller force and the number of times and different directions the paint roller is rolled over the work surface. After one pattern (e.g., in one color) is applied by one of the paint rollers 11–15 and permitted to dry, a second pattern (e.g., in a different color) can be applied by the same or different paint roller 11–15 and permitted to dry, etc. Thus, the effect achieved is a result of one or two or more separate and distinct painting stages, with each stage producing a selected pattern of a selected color. An unlimited number of variations and styles are possible, and the specific effect achieved is dependent on individual taste and creativity.

As indicated, each paint roller 11–15 can be manually rolled over a work surface with a paint roller handle in a generally conventional manner. Accordingly, the user can apply a "faux" finish or other special effect to a large area relatively quickly and with ease. In each stage of application, the user can experiment on a small test area first. In the negative mode of painting, the test area is repainted with a base coating (e.g., with a conventional roller) before the selected effect is applied to the entire work surface. In the positive mode of painting, the test area is cleaned before the desired effect is applied to the entire work surface.

The outer paint roll mediums 21–25 used in the five paint rollers 11–15 fall into three general categories hereafter referred to as "Compacted Sheet Medium"; "Sculptured Sponge Medium"; and "Combined Medium". Each category and each outer paint roll medium which falls into the category are described below under appropriate captions.

Compacted Sheet Medium—Generally

In this category, the outer paint roll medium is formed from a blank of flexible sheet material. A separate blank may be provided for each paint roller or a continuous blank of sheet material may be provided (e.g., from a roll of sheet material) for many paint rollers. As a first step in forming the outer medium, the blank is preformed into a loosely arranged three-dimensional shape by loosely compacting (e.g., crumpling) the blank, preferably in multiple directions and in an irregular manner. The preformed shape is then wrapped around an inner core. If a separate blank is provided for each paint roller, the preformed shape is wrapped around a roller core so that the preformed shape completely covers the roller core and overlaps circumferentially. If a continuous blank of sheet material is provided (e.g., from a roll of sheet material), the blank is preformed into a loosely arranged three-dimensional shape and then the preformed shape is wrapped spirally around elongated core stock generally as shown and described in the aforementioned U.S. Pat. No. 4,191,792. In each method, the outer annular medium is affixed to the inner core with a suitable adhesive. Where the preformed shape is wrapped spirally around elongated core stock, individual paint rollers are formed by cutting off selected lengths of the wrapped core stock. Where a separate preformed blank is wrapped around a roller core, the irregular side edges of the outer medium are trimmed in alignment with the ends of the roller core.

Where a separate blank is provided for each paint roller, the blank of sheet material is preferably rectangular and has a surface area significantly greater than the outer surface area of the roller core. For example, the rectangular blank has an axial dimension approximately 50% greater than the length of the roller core and a circumferential dimension approximately 50% greater than the circumference of the roller core and such that the total area of the blank is approximately 125% greater than the outer surface area of the roller core. If a preformed blank of sheet material is wrapped spirally around elongated core stock as described, the sheet material used for each paint roller also has a surface area approximately 125% greater than the outer surface area of the roller core. More generally, the blank of sheet material used for each paint roller has a surface area which is preferably at least 50% greater than the outer surface area of the roller core and as much as 300% or more greater than the outer surface area of the roller core, depending primarily on the type of sheet material used.

The flexible sheet material can be a non-porous material or a resilient, porous material. A flexible sheet of non-porous material is preferably provided by a thin sheet of suitable plastic. A flexible sheet of resilient, porous material is provided, for example, by a sheet of resilient, open-cell, foam material or a sheet of chamois-like cloth material. The sheet of porous material preferably has, in its relaxed state, approximately the same thickness (e.g., 1/16 to 1/8 inch) as natural chamois or heavy woven cloth.

Compacted Sheet Medium—Non-Porous Sheet

Figure 7:
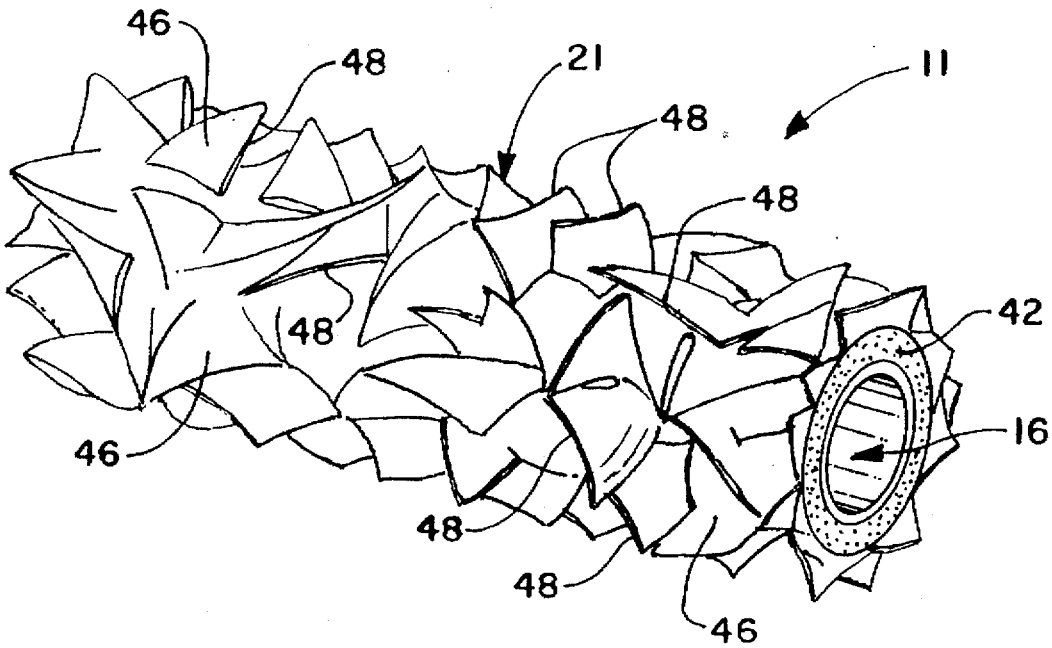

A paint roller 11 having an outer medium 21 formed from a thin flexible sheet 40 of non-porous plastic is shown in FIGS. 1 and 7. A perspective view of the paint roller 11 is shown in FIG. 7. Art axial section view of the paint roller 11 showing a typical outer profile of the outer medium 21 in its relaxed state is shown in FIG. 1. The outer medium 21 has a typical outer profile in transverse section which is similar to its typical outer profile in axial section.

The outer medium 21 is formed by loosely compacting (e.g., crumpling) a separate or continuous blank of the flexible sheet 40 of plastic in multiple directions and in an irregular manner and then wrapping the preformed shape of loosely arranged material around and affixing it to an inner core. In the embodiment shown in FIGS. 1 and 7, a separate resilient layer 42 is wrapped about the inner core before the outer medium 21. The outer medium 21 is either directly attached to the inner core (if an intermediate resilient layer 42 is not provided) or is affixed to the inner core by attaching the outer medium 21 to the intermediate resilient layer 42 (if provided). The outer medium 21 is attached where the outer medium 21, in its relaxed state, engages the inner core or layer 42 (e.g., by coating the entire outer surface of the inner core or layer 42 with adhesive or by applying spots of adhesive at ½ inch intervals along and around the inner core or layer 42). The intermediate layer 42, if provided, is suitably affixed to the inner core (e.g., by coating the entire outer surface of the core with a suitable adhesive before wrapping the intermediate layer 42 around the core).

The thin plastic sheet 40 must be rigid enough so that the outer medium 21 formed by the plastic sheet 40 retains its irregular shape and yet must be sufficiently resilient and flexible to enable the outer medium 21 to roll freely over a flat dry work surface (in the positive mode of painting) or over a flat, wet, freshly painted work surface (in the negative mode of painting). A polyethylene sheet having a thickness of four mils (0.004 inch) has been found to have the desired physical characteristics. An intermediate resilient layer 42 having a thickness, in its relaxed state, of approximately ¼ inch has been found desirable because it increases the resiliency of the outer medium 21.

In general, the surface area of the blank of non-porous sheet material used for each roller is between 100% to 300% or more greater than the outer surface area of the inner annular core. In the described paint roller 11, the plastic sheet blank used for each roller has a surface area between approximately 200% to 300% greater than the outer surface area of the roller core 16. For example, if a separate blank is provided for each paint roller 11, a rectangular blank is used having an axial dimension 70% to 100% greater than the length of the roller core 16 and a circumferential dimension 70% to 100% greater than the circumference of the roller core 16. The excess sheet material provides the material needed for producing the desired wrinkles and folds in the outer medium 21 and to form an outer medium 21 having, in its relaxed state, a radial thickness of approximately ⅜ to ½ inch or more and a radial resiliency of at least one-half the maximum radial thickness.

The plastic sheet blank is loosely compacted (e.g., crumpled) in multiple directions and in an irregular manner in such a way as to provide a large number of both short and long linear folds 44 (including both curved and straight linear folds) and both small and large intermediate, unfolded, surface areas 46 less than and greater than one square inch, respectively. Typically, most of the large intermediate surface areas 46 and some of the small intermediate surface areas 46 are wrinkled. In the relaxed state of the outer medium 21, the outermost folds 44 form irregular and undulating raised areas or ridges 48 at the outer surface of the outer medium 21. The undulating ridges 48 run in various and varying directions. Also, in the relaxed state of the outer medium 21, most of the large and small intermediate surface areas 46 are inclined at angles between 90° to 15° to the axis of the paint roller. In general, the intermediate surface areas 46 provide sloping, rolling, recessed surfaces which form inclined openings or embrasures within the outer surface of revolution of the outer medium 21. Some of the recessed surfaces 46 are deep enough to form "voids" in the outer medium 21 which do not contact the work surface.

The number and size of such "voids" is dependent on the radial thickness and resiliency of the outer medium 21 and the applied roller force when the paint roller is rolled over the work surface.

An outer medium provided by a non-porous sheet is primarily useful in the negative mode of painting. In the negative mode, the outer medium 21 produces a pattern of markings on a wet painted surface, in part by removing paint with the outer surface ridges 48 and other folds 44 and intermediate surface areas 46 but primarily by contacting the wet painted surface and smooshing or pushing the wet paint across the surface with the surface ridges 48 and other folds 44 and intermediate surface areas The outer paint roll medium 21 can also be used in the positive mode of painting. However, in the positive mode, because the plastic sheet 40 is non-porous and therefore does not hold a significant quantity of paint, the outer medium 21 has to be frequently loaded with paint.

Figure 11:
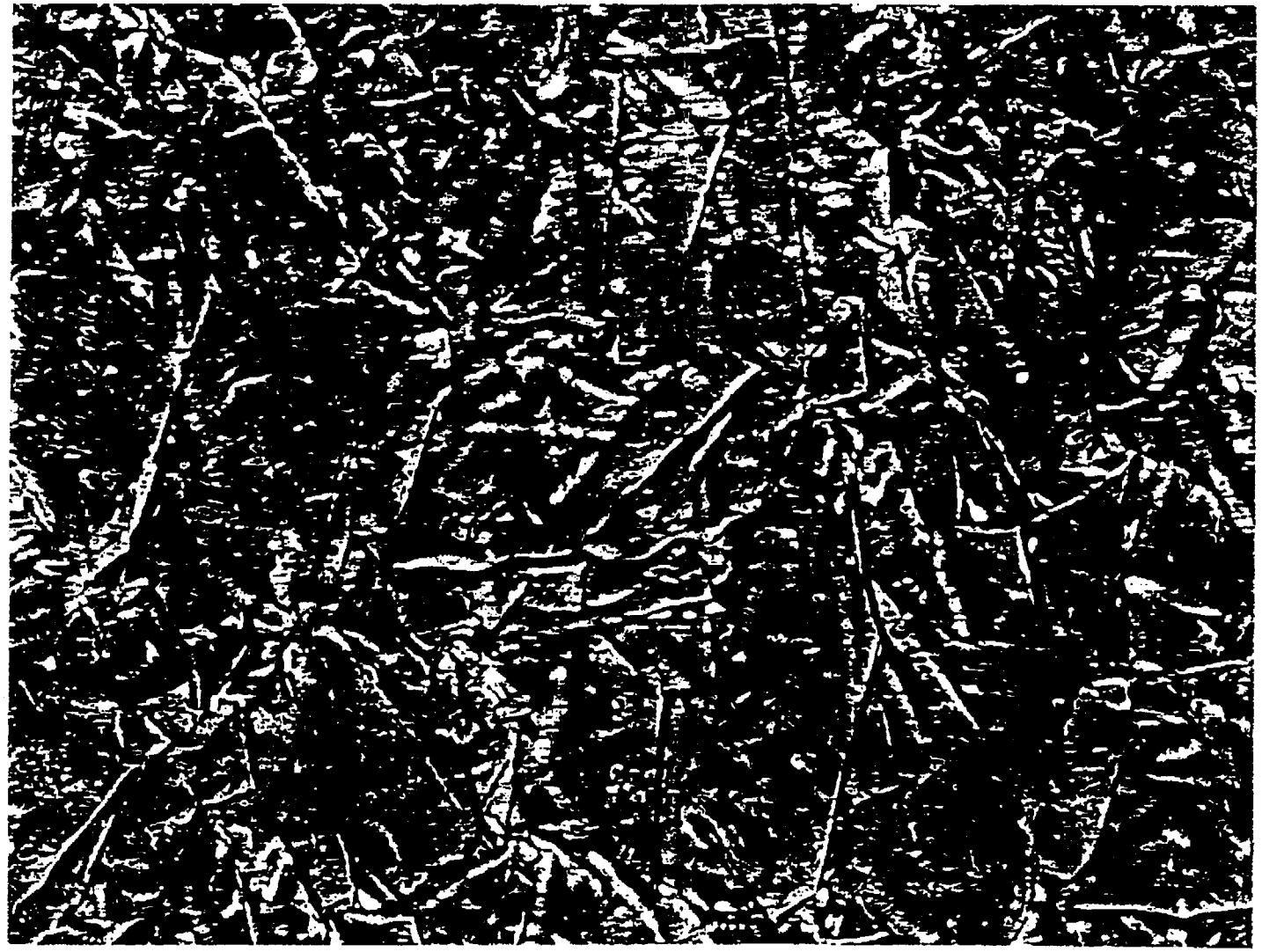
FIGS. 11–14 are black and white photocopies of color photographs of painted patterns produced by the paint rollers shown in FIGS. 1, 2, 4 and 5 respectively.

In either mode of painting, manually rolling the paint roller 11 repeatedly over the same work surface area produces increasingly intricate and smaller patterns due to the increased number of folds, wrinkles and unfolded surface areas which contact and mark the work surface. An example of a single stage pattern produced in the negative mode of painting by a paint roller 11 having the described plastic sheet outer medium 21 is shown in FIG. 11.

Compacted Sheet Medium—Porous Sheet

Figure 2:
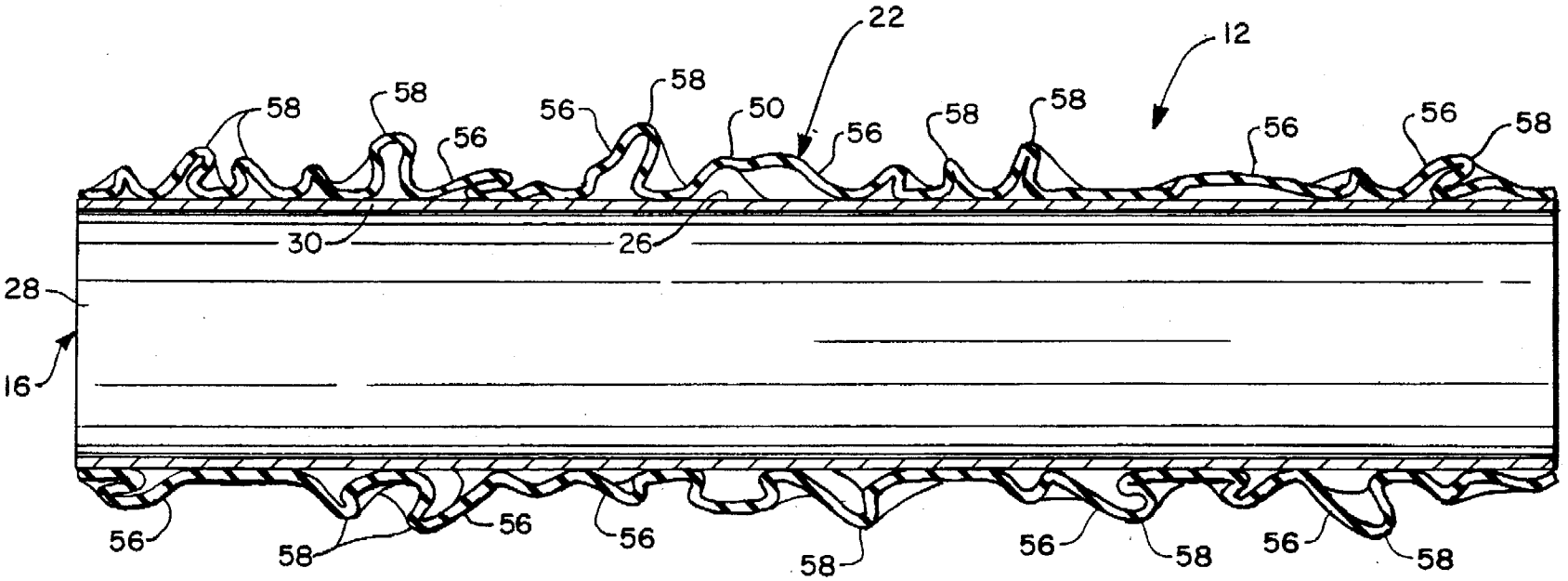
Figure 3:
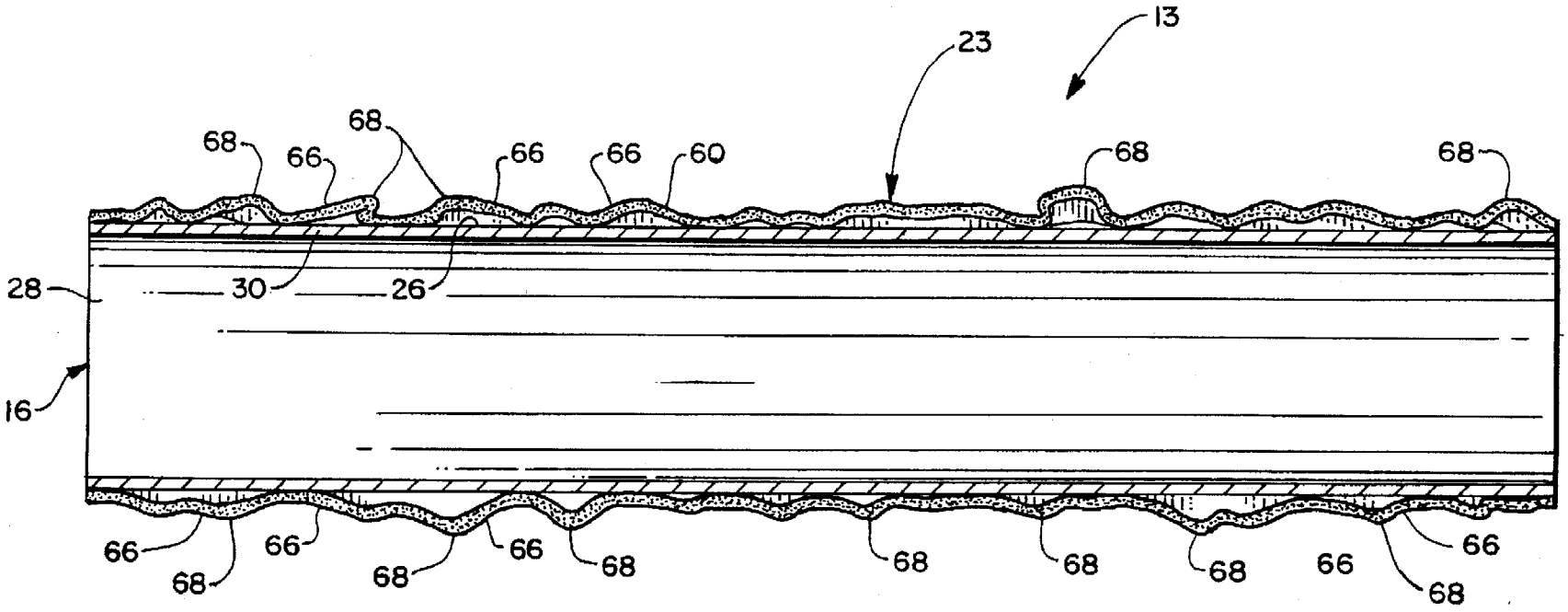
Figure 6:
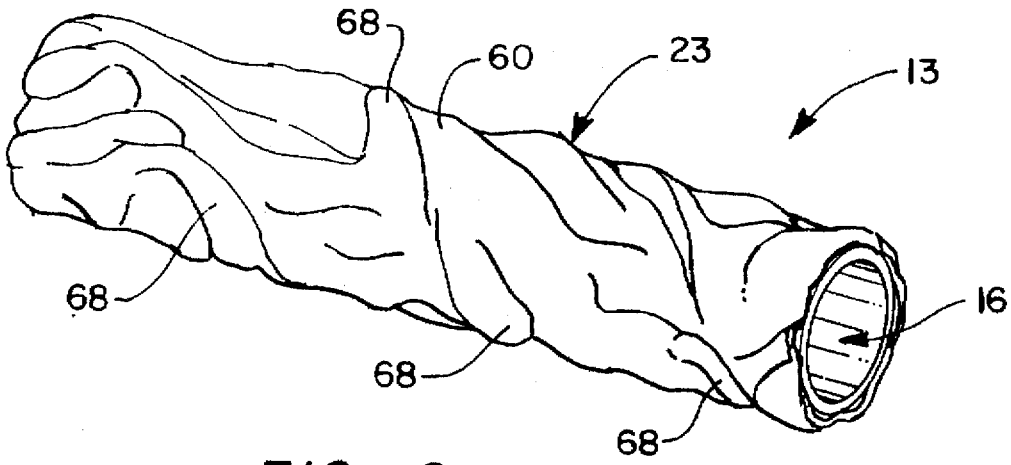
FIGS. 6–10 are reduced perspective views of the paint rollers shown in FIGS. 1–5.
Figure 10:
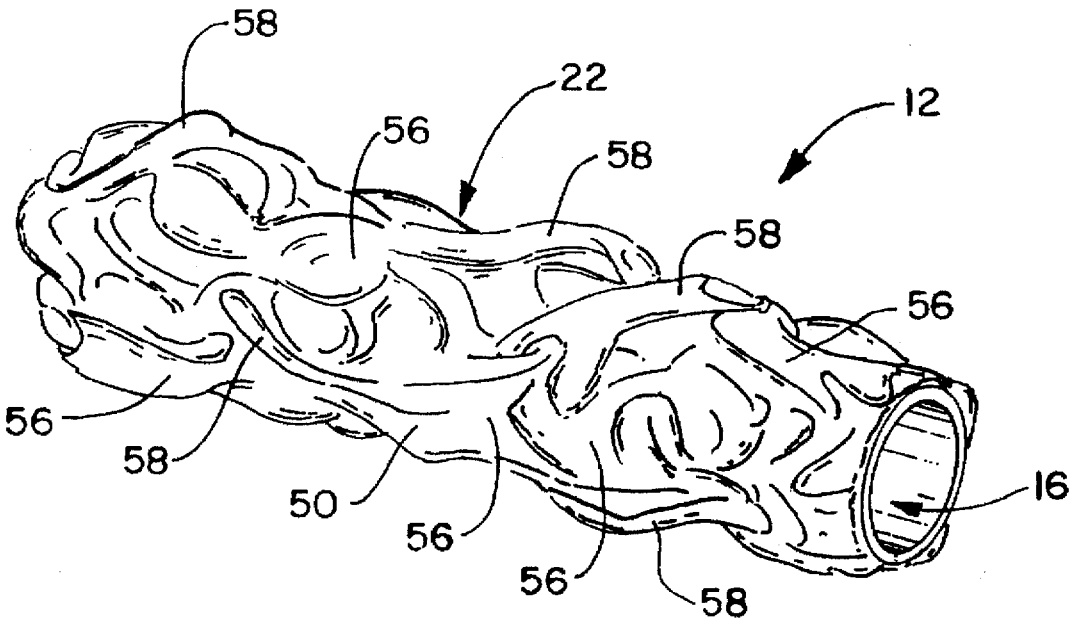

Two paint rollers 12, 13 having outer mediums 22, 23 formed from blanks of flexible sheets 50, 60 of resilient porous material are shown in FIGS. 2 and 10 and FIGS. 3 and 6 respectively. Perspective views of the paint rollers 12, 13 are shown in FIGS. 10 and 6. Axial section views of the paint rollers 12, 13 showing typical outer profiles of the outer mediums 22, 23 in their relaxed state are shown in FIGS. 2 and 3. Each outer medium 22, 23 has a typical outer profile in transverse section which is similar to its typical outer profile in axial section.

In the paint roller 12 shown in FIGS. 2 and 10, the outer medium 22 is provided by a multiple layer sheet 50 of resilient, open-cell foam rubber material having a thickness, in its relaxed state, of approximately 1/16 inch. The cells or pores of the foam material are preferably relatively small (e.g., approximately 1/16 inch or less) so as to provide a relatively smooth outer surface. In the paint roller 13 shown in FIGS. 3 and 6, the outer medium 23 is provided by a sheet 60 of synthetic chamois cloth (unwoven) having a thickness, in its relaxed state, of approximately 1/8 inch.

Each outer medium 22, 23 is formed by loosely compacting a separate or continuous blank of the porous sheet 50, 60 in multiple directions and in an irregular manner into a three dimensional shape and then wrapping the preformed shape of loosely arranged material around and affixing it to an inner core. The sheet blank is loosely arranged in such a way as to provide an outer medium 22, 23 having many outer surface folds or ridges 58, 68 and many intermediate, recessed surface areas 56, 66. Excess sheet material provides the material needed for producing the ridges 58, 68 and intermediate surface areas 56, 66 and to form, in its relaxed state, an outer medium 22, 23 having ridges or raised areas 58, 68 with a height of approximately 3/8 inch or more and a radial resiliency greater than the thickness of the sheet 50, 60. The outer medium 22, 23 is affixed to the inner core (e.g., by coating the entire outer surface of the inner core with adhesive or by applying spots of adhesive at 1/2 inch intervals along and around the inner core) so that the outer medium 22, 23 is attached to the inner core where the outer medium 22, 23, in its relaxed state, engages the inner core.

Each of the porous outer mediums 22, 23 is primarily useful in the positive mode of painting but can also be used in the negative mode of painting. In the positive mode, the work surface is marked with paint where the outer medium 22, 23 contacts the work surface as the paint roller 12, 13 is manually rolled over the work surface. The porous sheet 50, 60 is preferably sufficiently thick and porous to enable the outer medium 22, 23 to hold a reasonable quantity of paint when used in the positive mode of painting. The described foam rubber sheet and described synthetic chamois cloth have been found to have the desired physical characteristics.

In general, the blank of porous sheet material used for each roller has a surface area at least 50% greater than and up to 200% greater than the outer surface area of the inner core. The described outer mediums 22, 23 are formed with significantly less excess sheet material than the described plastic outer medium 21. For example, the surface area of the blank of porous sheet material used for each paint roller 12, 13 is approximately 125% greater than the outer surface area of the roller core 16. Accordingly, the number of folds 58, 68 and intermediate surface areas 56, 66 in the outer mediums 22, 23 is significantly less than the number of folds 44 and intermediate surface areas 46 in the described plastic outer medium 21. The folds 58, 68 provide relatively smooth and undulating ridges or raised areas 58, 68 along the surface of the paint roller and provide many intermediate, recessed, rolling surface areas 56, 66 which are inclined at angles between 90° to 15° to the axis of the paint roller. The undulating ridges or raised areas 58, 68 run in various and varying directions.

Because the surface area of the blank of porous sheet material used in each of the outer mediums 22, 23 is significantly less than the surface area of the blank used in the described plastic sheet outer medium 21, each of the outer mediums 22, 23 has significantly fewer, if any, undercuts formed by overlapping material. Also, in general, the outer profile of each of the outer mediums 22, 23 is considerably less intricate and labyrinthine than the outer profile of the described plastic sheet outer medium 21.

In the positive mode of painting, the outer raised areas 58, 68 of the outer mediums 22, 23 apply the most paint to the work surface. The intermediate, rolling surface areas 56, 66 adjacent the outer areas 58, 68 apply less paint to the work surface and consequently produce a shading effect. Some of the deepest recessed areas in the outer mediums 22, 23 form "voids" which do not contact the work surface.

Figure 12:
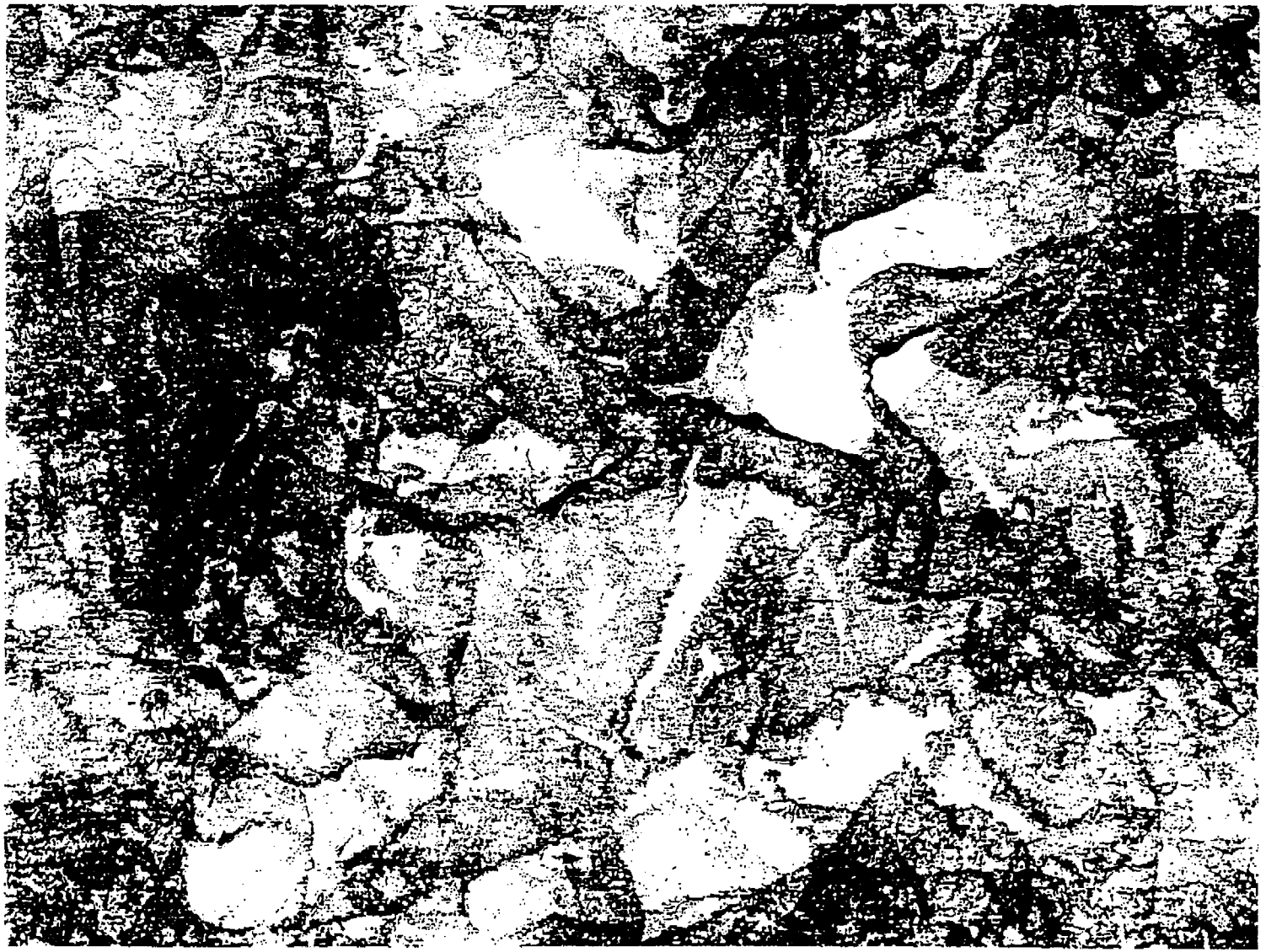

The "faux" finish or other effect produced by each of the paint rollers 12, 13 in the positive mode of painting is not unlike that produced by a paint roller 11 having the described plastic sheet outer medium 21 when the plastic sheet outer medium 21 is used in the negative mode of painting. In general, however, the patterns produced by the described outer mediums 22, 23 have significantly fewer linear markings and a much softer appearance than the patterns produced by the described plastic sheet outer medium 21. Art example of a single stage pattern produced in the positive mode of painting by a paint roller 12 having the described porous sheet outer medium 22 is shown in FIG. 12.

Sculptured Sponge Medium

In this category, the outer paint roll medium 24 is formed by either natural sponge material or synthetic sponge (i.e., sponge-like) material 70. In each case, the material is a resilient, porous, open-cell, material. Where a synthetic sponge material is used, the material preferably has relatively large pockets and other openings in the outer surface.

Figure 4:
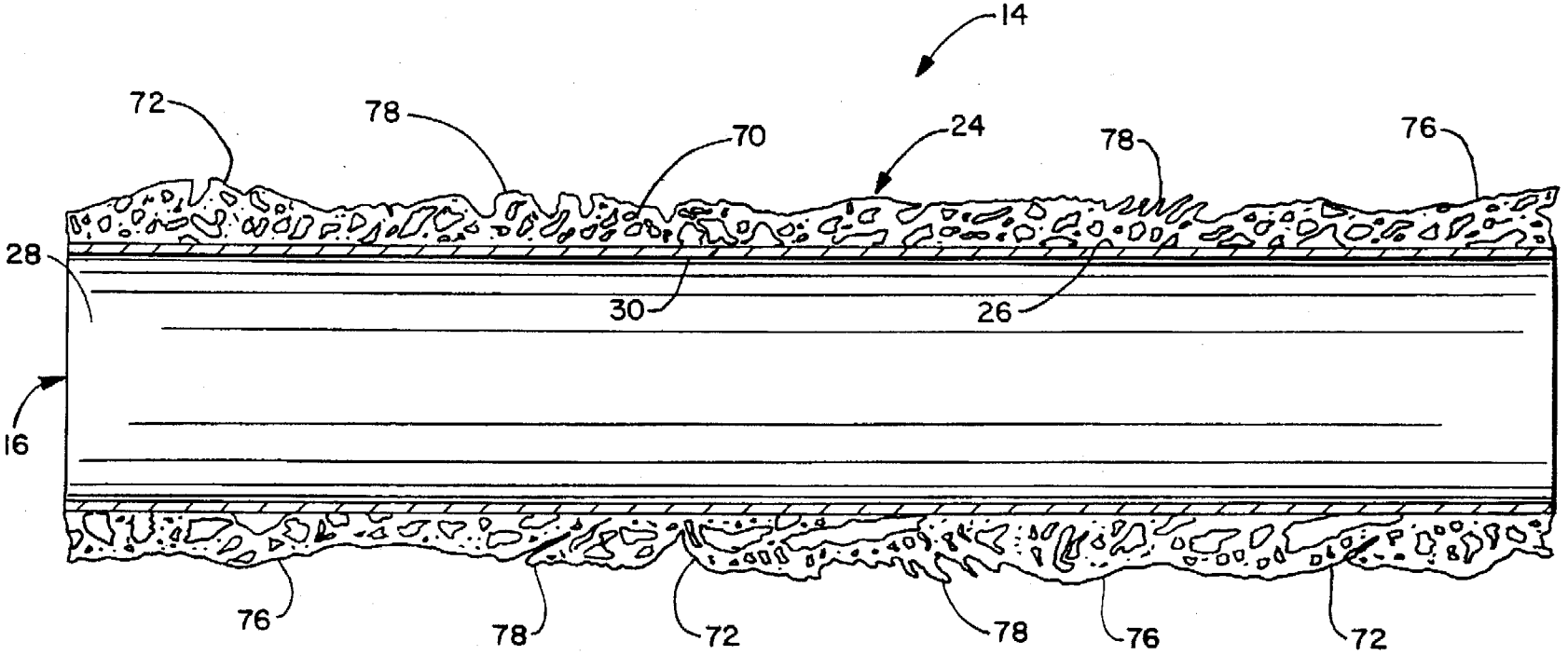
Figure 9:
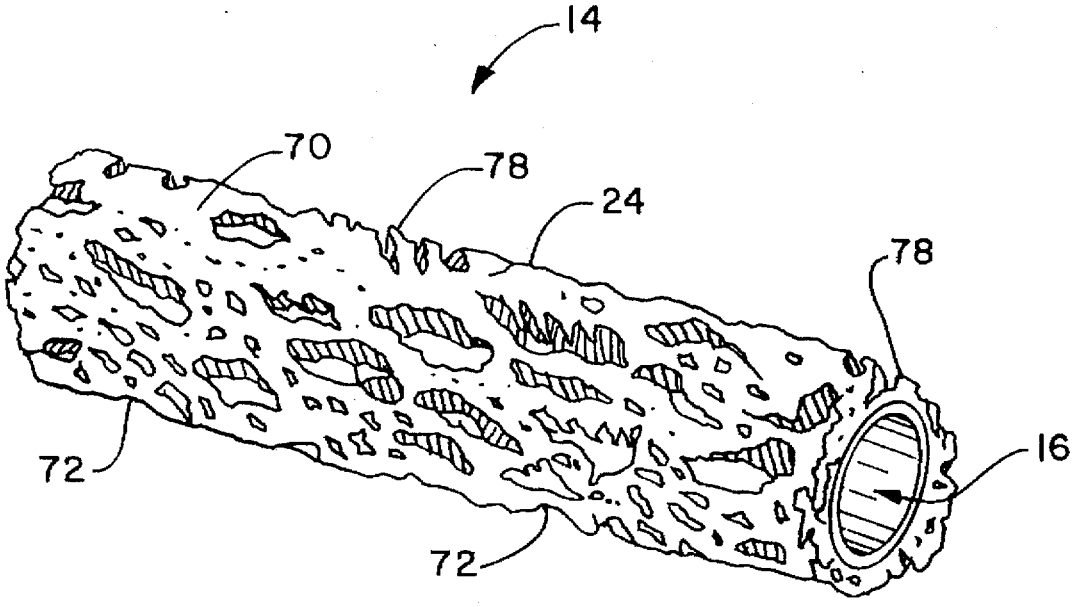

A paint roller 14 having a sculptured outer medium 24 is shown in FIGS. 4 and 9. A perspective view of the paint roller 14 is shown in FIG. 9. An axial section view of the paint roller 14 showing a typical outer profile of the outer medium 24 in its relaxed state is shown in FIG. 4. The outer medium 24 has a typical outer profile in transverse section which is similar to its typical outer profile in axial section.

The outer medium 24 is formed by wrapping a preformed shape of natural or synthetic sponge material 70 about an inner core and then affixing the preformed shape to the inner core. In FIGS. 4 and 9, the outer medium 24 is formed by a preformed shape 72 of natural sponge material 70. To facilitate production of the paint rollers 14, the outer medium 24 is preferably formed by a single preformed shape of synthetic sponge material wrapped about the inner core. The preformed shape 72 is attached directly to the inner core, for example by coating the entire outer surface of the inner core with adhesive before wrapping the preformed shape 72 of sponge material 70 around the inner core.

The sponge material 70 is preformed so that the outer medium 24, in its relaxed state, has a sculptured outer surface with a height above the roller core which varies between a minimum height of approximately ⅛ inch and a maximum height of approximately ½ inch or more. The sculptured outer surface is provided by the large pockets and other openings in the outer surface and by outwardly projecting fingers at the outer surface. Together, the openings and fingers provide outer ridges or raised areas 78 running in various and varying directions. Some of the raised areas 78 form rounded peaks. The sculptured outer surface also has intermediate, recessed, rolling surface areas 76 which are inclined at an angle of less than 60°, and typically within a range of approximately 15°–45° to the axis of the paint roller. "Voids" are provided in the outer medium 24 by the large pockets and other openings in the outer surface. In general, the sculptured outer surface may be like the irregular outer surface provided by the described porous sheet outer mediums 22, 23 except that, in the sculptured outer medium 24, the outer surface profile is more intricate than the outer surface profiles of the described porous sheet outer mediums 22, 23.

Figure 13:
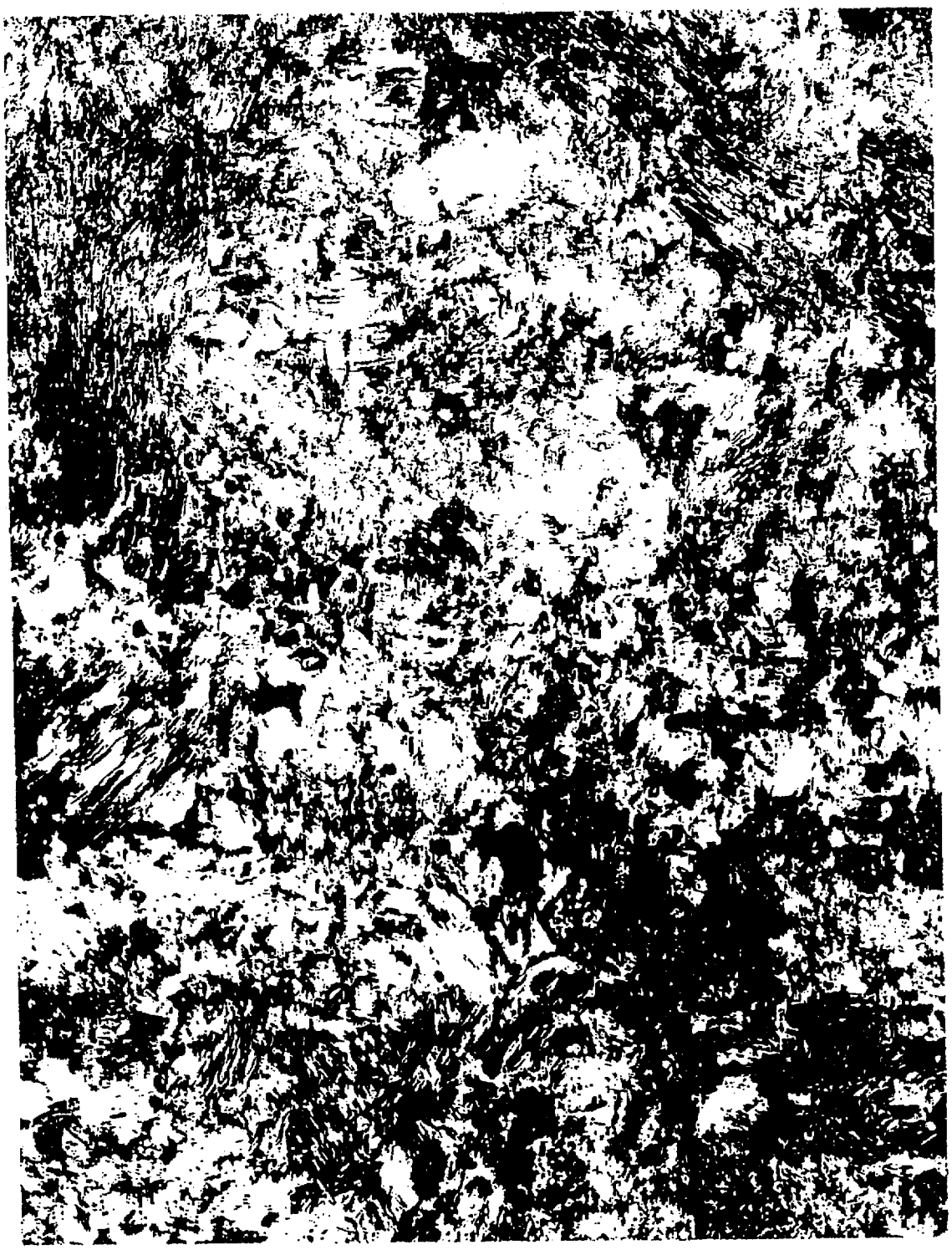

The sculptured outer medium 24 is primarily useful in the positive mode of painting and, in that mode, produces a "faux" finish or other effect generally like that produced by the described porous sheet outer mediums 22, 23. An example of a single stage pattern produced in the positive mode of painting by the described sculptured outer medium 24 is shown in FIG. 13.

Combined Medium

Figure 5:
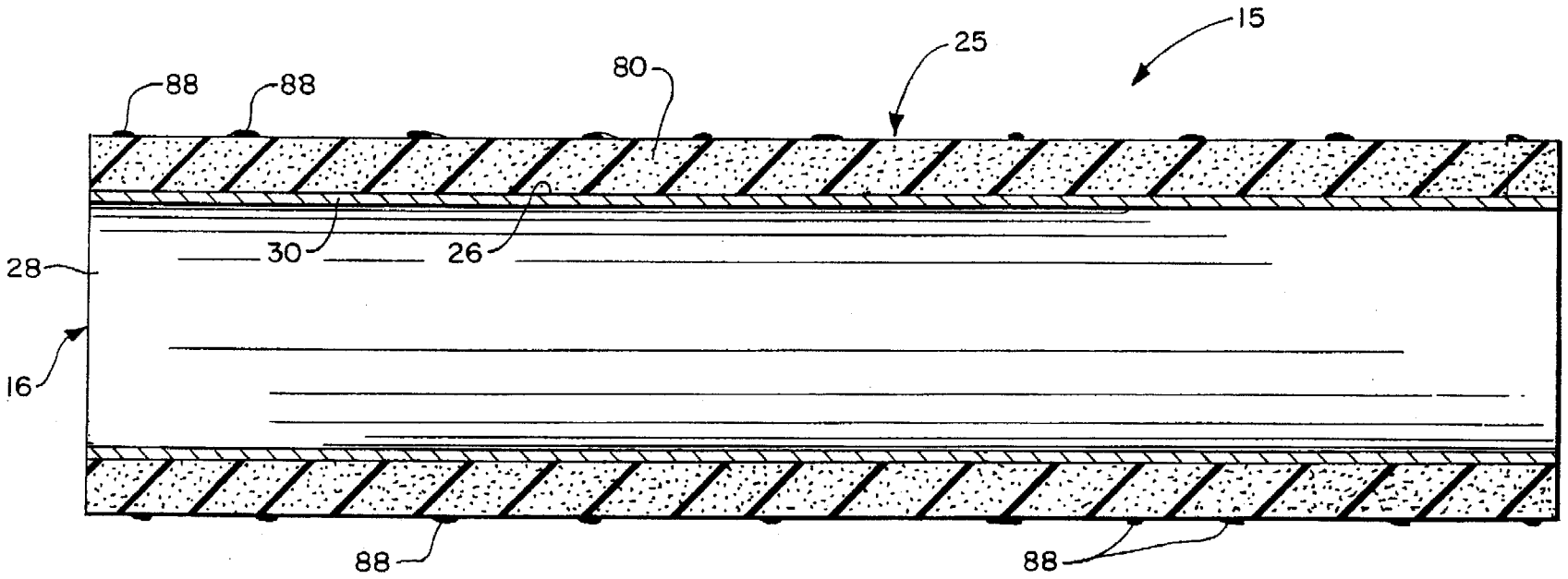
Figure 8:
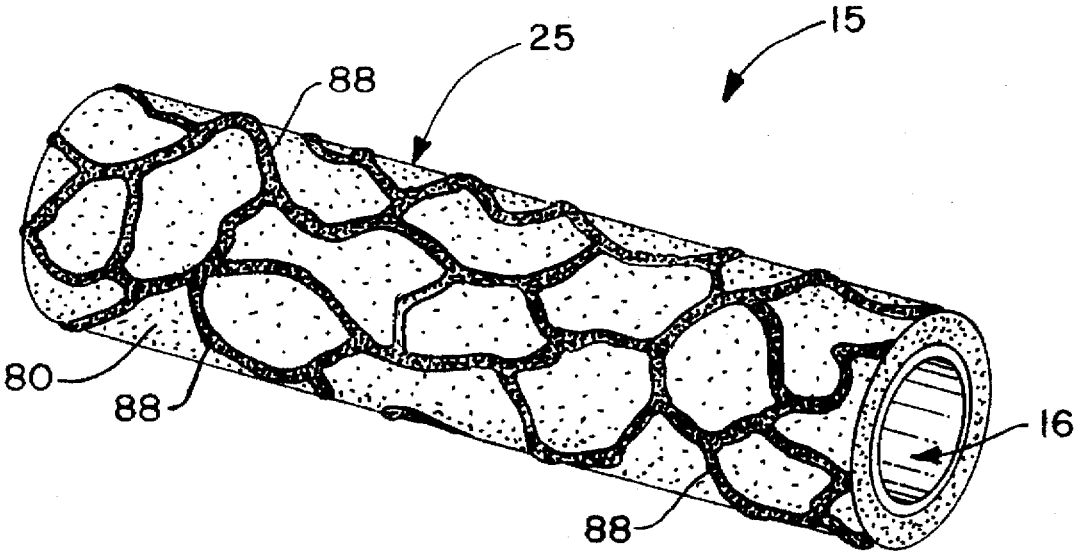

In this category, the outer paint roll medium 25 is formed by a base layer 80 of resilient porous material wrapped around and affixed to the inner core and by relatively hard areas 88 of non-porous material at the outer surface of the base layer 70. A paint roller 15 having such an outer medium 25 is shown in FIGS. 5 and 8. A perspective view of the paint roller 15 is shown in FIG. 8. An axial section view of the paint roller 15 showing a typical outer profile of the outer medium 25 in its relaxed state is shown in FIG. 5. The outer medium 25 has a typical outer profile in transverse section which is similar to its typical outer profile in axial section.

The resilient porous material forming the base layer 80 is preferably a resilient, open-cell, foam material having relatively small cells or pores. The base layer 80 may also be formed by a resilient, high quality, hair material. In the alternative, the material may be the same as or similar to the resilient porous material used in the described sculptured outer medium 24. Also, the base layer 80 may have a sculptured outer surface like the outer surface of the described sculptured outer medium 24. The base layer 80 is preferably about ⅜ to ½ inch thick in its relaxed state. The base layer 80 is formed by wrapping a sheet (or by wrapping a preformed shape, if a sculptured outer surface is provided) of a suitable material about an inner core and then affixing the layer of material to the inner core. The base layer 80 is attached directly to the inner core, for example by coating the entire outer surface of the inner core with adhesive before wrapping the base layer 80 around the inner core. In the alternative, a base layer 80 of foam material is formed directly on and attached to the core.

The relatively hard areas 88 of non-porous material preferably have an outer smooth surface raised above the base layer 80 and are preferably formed by applying a non-porous material to the outer surface of the base layer 80. For example, a resilient caulking material (e.g., silicon or butyl rubber caulking) is applied in stripes to form raised beads 88 of non-porous material on the base layer 80.

Relatively hard areas of non-porous material can also be formed by selectively applying a suitable glue or other liquid (e.g., in stripes of varying widths) to the surface of the base material 80 and so that the liquid is absorbed into the surface of the base layer 80 and dries to form relatively hard, smooth, non-porous areas on the surface of the base layer 80.

The relatively hard, non-porous surface areas 88 can be provided in stripes in an irregular manner (e.g., with the stripes 88 approximately 1 to 1¼ inch apart) and in varying widths (e.g., varying between ⅛ inch to ⅜ inch or more) as shown in FIGS. 5 and 8. In the alternative, the relatively hard, non-porous surface areas 88 can be provided in a regular pattern (e.g., in stripes having a constant width and/or in parallel rows extending axially along the base layer 80 or circumferentially or spirally around the base layer 80).

Figure 14:
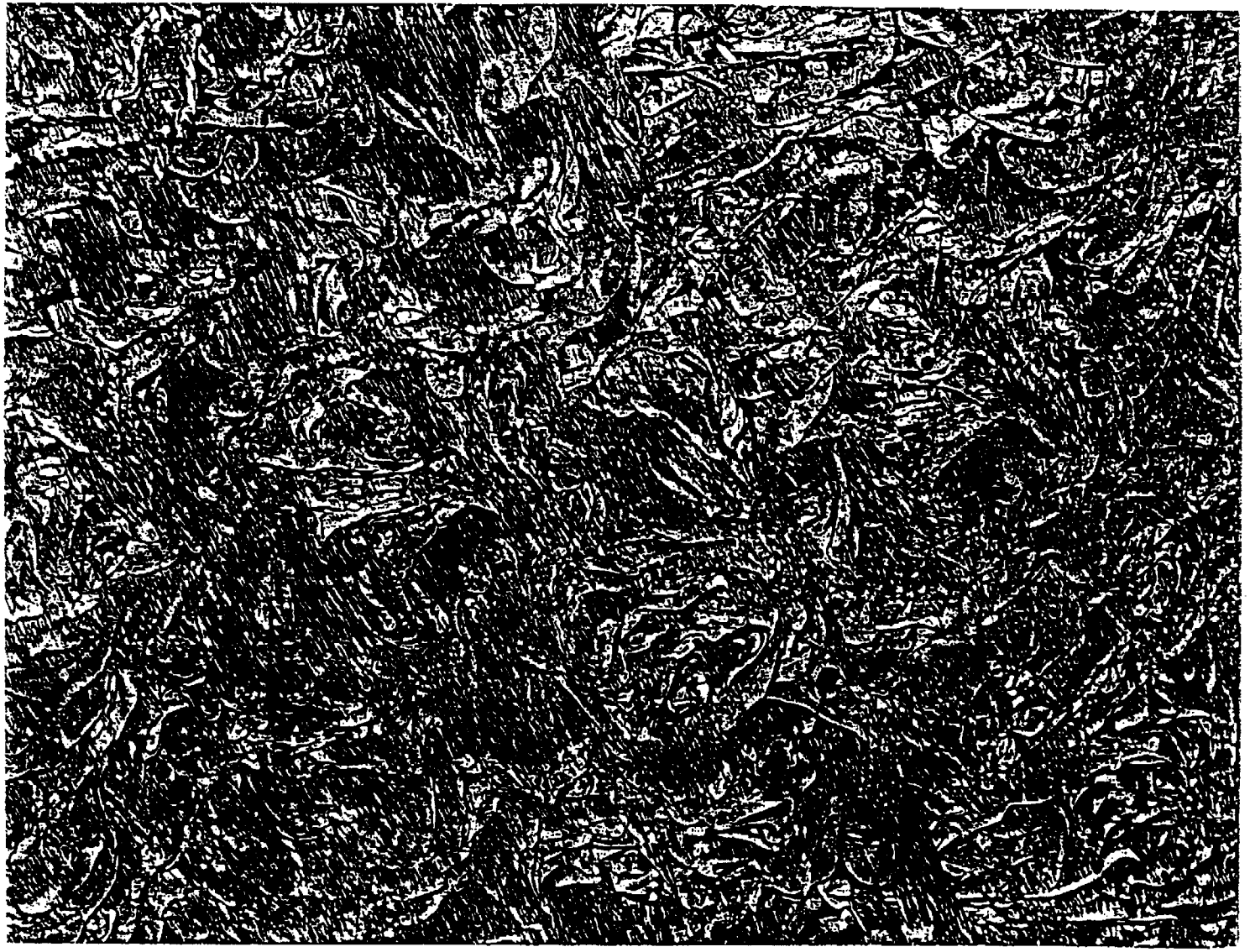

The resilient porous base layer 80 serves to apply paint to a work surface in the positive mode of painting. At the same time, the relatively hard, non-porous surface areas 88 mark the wet painted surface in the negative mode of painting. The relatively hard, non-porous surface areas 88 are pressed into the underlying material of the resilient layer 80 as they are rolled over the work surface. The relatively hard, non-porous surface areas 88 mark the surface, in part by removing paint, but primarily by smooshing or pushing the wet paint across the work surface. An example of a single stage pattern produced in a combined positive and negative mode of painting by a paint roller 15 having the described outer medium 25 is shown in FIG. 14.

As will be apparent to persons skilled in the art, various modifications, adaptations and variations of the foregoing specific disclosure can be made without departing from the teachings of the present invention.

What is claimed is:

1. In a paint roller having an inner core with an outer annular surface and a radially resilient, outer, annular paint roll medium extending around the inner core and affixed to the inner core for rotation therewith; the improvement wherein the outer medium comprises a layer of resilient porous material extending around and affixed to the inner core and non-porous areas on the outer surface of the layer of resilient porous material.

2. A paint roller according to claim 1 wherein the non-porous areas comprise beads of non-porous material on the outer surface of the layer of resilient porous material, the non-porous material being harder than the resilient porous material.

3. A paint roller according to claim 2 wherein the beads extend irregularly in various directions.

4. A paint roller according to claim 1 wherein the non-porous areas comprise non-porous material on the outer surface of the layer of resilient porous material.

5. In a paint roller having an inner core with an outer generally cylindrical surface and an outer, annular paint roll medium extending around the inner core and affixed to the inner core for rotation therewith, the outer medium being resilient in the radial direction; the improvement wherein the paint roller further comprises an intermediate layer of resilient material between the inner core and the outer medium, and wherein the outer annular medium comprises a flexible sheet of non-porous material having a surface area significantly greater than the area of the outer surface of the inner core, the outer medium, in its relaxed state, being a loosely compacted three-dimensional shape of the flexible sheet of material having an irregular outer surface with a plurality of raised areas extending irregularly in various directions, the flexible sheet of non-porous material overlying the intermediate layer of resilient material, and the intermediate layer of resilient material increasing the resiliency of the outer medium.

6. A paint roller according to claim 5 wherein the three-dimensional shape has a plurality of sections, each formed by overlapping portions of the flexible sheet of material.

7. A paint roller according to claim 5 wherein the flexible sheet of non-porous material is a flexible sheet of plastic and has a surface area at least greater than the area of the outer surface of the inner core.

8. A paint roller according to claim 5 wherein, in the three-dimensional shape of the flexible sheet of material, the flexible sheet of material is loosely compacted in multiple directions and in an irregular manner and wherein the three-dimensional shape of the flexible sheet of material has an irregular arrangement of folds forming at least some of said raised areas.

9. A paint roller according to claim 5 wherein the outer medium, in its relaxed state, has, in multiple circumferential and axial sections of the outer medium, an irregular outer surface profile provided by the three-dimensional shape of the flexible sheet of material.

10. A paint roller according to claim 5 wherein the outer medium, in its relaxed state, has in multiple circumferential and axial sections of the outer medium, a sculptured outer surface profile provided by the three-dimensional shape of the flexible sheet of material.

11. In a paint roller having an inner core with an outer generally cylindrical surface and an outer, annular paint roll medium comprising a layer of resilient porous material extending around the inner core and affixed to the inner core for rotation therewith, the outer medium being resilient in the radial direction; the improvement wherein the outer medium, in its relaxed state, has an irregular outer surface with a plurality of raised surface areas extending irregularly in various directions, the raised surface areas comprising non-porous areas on the outer surface of said layer of resilient porous material.

12. A paint roller according to claim 11 wherein the non-porous areas are provided by raised beads of non-porous material on the outer surface of said layer of resilient porous material, the non-porous material being harder than the resilient porous material.

13. In a paint roller having an inner core with an outer annular surface and a radially resilient, outer, annular paint roll medium extending around the inner core and affixed to the inner core for rotation therewith; the improvement wherein the outer medium has an outer annular surface comprising surface areas of resilient porous material and surface areas of non-porous material.

14. A paint roller according to claim 13 wherein the non-porous material is harder than the resilient porous material.

* * * * *

UNITED STATES PATENT AND TRADEMARK OFFICE

CERTIFICATE OF CORRECTION

PATENT NO. : 5,693,141

DATED : December 2, 1997

INVENTOR(S) : Thomas J. Tramont

It is certified that error appears in the above-indentified patent and that said Letters Patent is hereby corrected as shown below:

Column 11, line 24, after "least" insert --200%--.

Signed and Sealed this

Twenty-seventh Day of October, 1998

*Attest:*

Bruce Lehman

BRUCE LEHMAN

*Attesting Officer*

*Commissioner of Patents and Trademarks*